US006340175B1

(12) United States Patent
Hughes et al.

(10) Patent No.: US 6,340,175 B1
(45) Date of Patent: Jan. 22, 2002

(54) AIR BAG ASSEMBLIES WITH FOAMED ENERGETIC IGNITERS

(75) Inventors: Craig D. Hughes, Salt Lake City; Daniel W. Doll, North Ogden, both of UT (US); Gary K. Lund, Malad, ID (US); Dean M. Lester, Brigham City, UT (US)

(73) Assignee: Alliant Techsystems, Inc., Edina, MN (US)

( * ) Notice: Subject to any disclaimer, the term of this patent is extended or adjusted under 35 U.S.C. 154(b) by 0 days.

(21) Appl. No.: 09/417,713

(22) Filed: Oct. 13, 1999

Related U.S. Application Data

(60) Provisional application No. 60/104,267, filed on Oct. 14, 1998.

(51) Int. Cl.[7] ..... B60R 21/28

(52) U.S. Cl. ..... 280/741; 149/2; 149/19.1; 149/19.4; 102/202.5; 102/202.7; 102/205

(58) Field of Search ..... 280/741; 149/19.4, 149/19.1, 2; 102/202.5, 202.7, 205

(56) References Cited

U.S. PATENT DOCUMENTS

| | | | | |
|---|---|---|---|---|
| 2,959,001 A | | 11/1960 | Porter | 60/35.6 |
| 3,062,147 A | | 11/1962 | Davis et al. | 102/70 |
| 3,198,677 A | | 8/1965 | Thomas | |
| 3,254,603 A | | 6/1966 | Gould | 102/70 |
| 3,434,426 A | | 3/1969 | Dapper | 102/100 |
| 3,619,306 A | * | 11/1971 | Berthmann et al. | 149/18 |
| 3,692,495 A | * | 9/1972 | Schneiter et al. | 149/77 |
| 3,730,093 A | * | 5/1973 | Cummings | 149/15 |
| 3,878,791 A | * | 4/1975 | Askwith et al. | 149/2 |
| 4,025,369 A | * | 5/1977 | Price et al. | 149/2 |
| 4,063,508 A | * | 12/1977 | Whiting | 149/2 |
| 4,115,999 A | * | 9/1978 | Diebold | 149/19.4 |
| 4,151,022 A | * | 4/1979 | Donaghue et al. | 149/19.4 |
| 4,358,998 A | * | 11/1982 | Schneiter et al. | 280/741 |
| 4,690,063 A | * | 9/1987 | Granier et al. | 102/202.5 |
| 4,861,397 A | * | 8/1989 | Hillstrom | 149/19.4 |
| 4,915,754 A | * | 4/1990 | Hightower et al. | 149/19.4 |
| 5,062,365 A | | 11/1991 | Canterberry | 102/322 |
| 5,067,996 A | * | 11/1991 | Lundstrom et al. | 149/19.4 |
| 5,218,166 A | * | 6/1993 | Schumacher | 102/431 |
| 5,472,533 A | | 12/1995 | Herbage et al. | 149/41 |
| 5,542,688 A | * | 8/1996 | Scheffee | 280/741 |
| 5,670,735 A | | 9/1997 | Ortmann et al. | 102/202 |
| 5,792,982 A | * | 8/1998 | Scheffee | 149/2 |
| 6,224,099 B1 | * | 5/2001 | Nielson et al. | 280/741 |

FOREIGN PATENT DOCUMENTS

| | | |
|---|---|---|
| EP | 0 595 668 A1 | 5/1994 |
| EP | 0 665 138 A2 | 12/1994 |

* cited by examiner

*Primary Examiner*—Edward A. Miller

(57) ABSTRACT

An air bag igniter including a foamed material, and an air bag assembly containing the same are disclosed. The foamed material is formed from a composition including, as ingredients, a polyfunctional isocyanate, a polymeric binder having a plurality of hydroxyl groups which are reactive with the polyfunctional isocyanate, a fuel source, an oxidizer, and a foaming agent which may or may not be retained in the foamed material.

18 Claims, 2 Drawing Sheets

AIR BAG ASSEMBLIES WITH FOAMED ENERGETIC IGNITERS

Priority is claimed based on Provisional Application 60/104,267 filed on Oct. 14, 1998, the complete disclosure of which is incorporated herein by reference.

BACKGROUND OF THE INVENTION

1. Field of the Invention

This invention relates to igniters suited for use in air bag applications, and to air bag assemblies equipped with the igniters. More particularly, this invention relates to air bag igniters comprising a foamed igniter material.

2. Description of the Related Art

One important use for specifically formulated gas generating chemical compositions is in the operation of inflatable safety restraint systems, commonly referred to as air bag assemblies. Air bag assemblies are gaining in industrial and commercial acceptance to the point that many, if not most, new automobiles are equipped with such devices. Indeed, many new vehicles are equipped with multiple air bags to protect the driver and passengers, and contain multiple air bags for protection of each occupant.

Upon actuation of a vehicle's supplemental (or secondary) restraint system upon impact of the vehicle in an accident or the like, sufficient gas must be generated to fully inflate the air bag of the supplemental restraint system before the driver would otherwise be thrust against the steering wheel or dashboard. Generally, the air bag must be inflated within a fraction of a second. As a consequence, nearly instantaneous gas generation is required.

Typically, generation of the amount of gas necessary for inflating an air bag is achieved through a sequential ignition of specifically formulated compositions. This chain commonly begins with a squib comprising two spaced-apart electrical terminals and a high-resistance yet conductive material connecting the terminals. Upon application of a predetermined amount of electrical energy to the electrical terminals, the squib generates heat sufficient to fire an igniter material positioned in operative relation with the squib. The ignited igniter material in turn ignites a gas generating material, often in the form of pellets, present in sufficient amounts to generate the gas to fully inflate the air bag, or deploy the inflating gas as in a so-called hybrid system. Suitable gas generating materials and air bag constructions are well known to those skilled in the art. For example, it has been known to use sodium azide gas generants, although others are known and contemplated within the scope of this invention.

Boron potassium nitrate ($BKNO_3$) granules have conventionally been used as the igniter material. However, a drawback of the $BKNO_3$ granules is that they tend to become friable or brittle when subjected to continued application of loads or pressures over extended periods of time. The deterioration of the granules increases the burn rate of the $BKNO_3$, and may lead to over-pressurization during ignition, which can adversely affect performance.

It would therefore be a significant advancement in the art to provide an igniter material that is relatively insensitive to high impact loads.

SUMMARY OF THE INVENTION

It is, therefore, an object of this invention to provide an igniter composition that addresses a long-felt need in the art by addressing the aforementioned drawbacks associated with conventional igniter materials.

In accordance with the principles of this invention, these and other objects are attained with the inventive air bag igniter, which comprises a foamed material.

In accordance with a first embodiment of this invention, the foamed material is formulated from a composition comprising, as ingredients, at least one polyfunctional isocyanate, at least one non-energetic curable binder having a plurality of functional groups which are reactive with the polyfunctional isocyanate, at least one fuel source, at least one oxidizer, and at least one foaming agent which imparts porosity to the foamed material and may or may not be retained in the foamed material.

In accordance with a second embodiment of this invention, the foamed material is formulated from a composition comprising, as ingredients, at least one polyfunctional isocyanate, one or more energetic curable binders having a plurality of functional groups which are reactive with the polyfunctional isocyanate, one or more fuel sources other than the energetic curable binder(s), at least one oxidizer, and at least one foaming agent which imparts porosity to the foamed material and may or may not be retained in the foamed material.

In accordance with a third embodiment of this invention, the foamed material is formulated from a composition like that of the second embodiment, with the exception of being free of any fuels other than the energetic polymeric binder.

It is also an object of this invention to provide an air bag assembly that can be fired with a high confidence and consistent predictability. In accordance with the principles of this invention, this and other objects of the invention are attained by the provision of an air bag assembly comprising a gas generant (e.g., gas generating pellets) and at least one of the above-described air bag igniters in cooperative association with the gas generant so as to allow for ignition of the gas generant with high reliability. This invention also relates to vehicles, such as cars, sports utility vehicles, and trucks, comprising the air bag assembly positioned either (a) in a front position to protect the vehicle occupants from collision against the instrument panel or (b) in a side position to protect the vehicle occupants from impact against the door panel and/or compartment ceiling.

These and other objects, features, and advantages of the present invention will become apparent from the accompanying drawings and following detailed description which illustrate and explain, by way of example, the principles of the present invention.

BRIEF DESCRIPTION OF THE DRAWINGS

The accompanying drawings illustrate embodiments of this invention. In such drawings.

DETAILED DESCRIPTION OF EMBODIMENTS OF THE INVENTION

Figure 1:
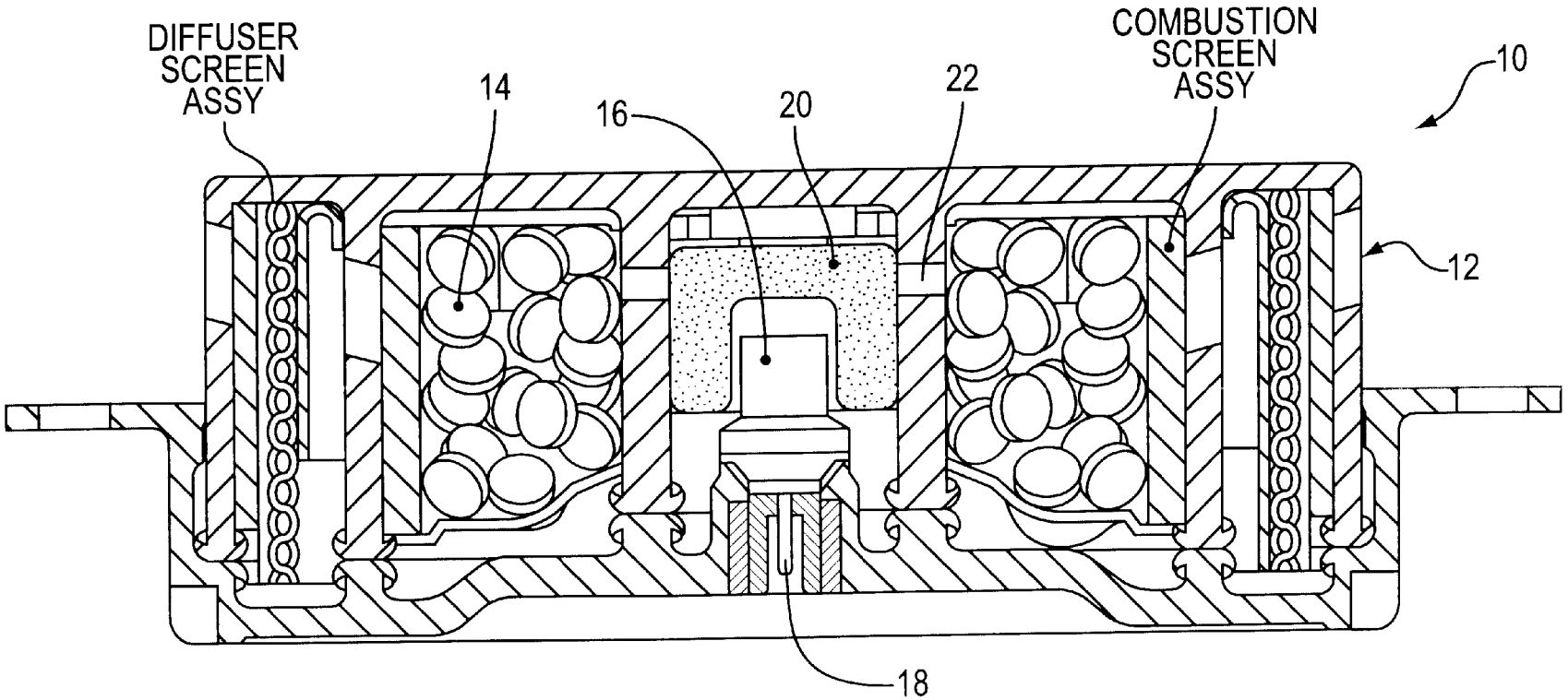
FIG. 1 is a simplified schematic sectional view of an air bag assembly in accordance with this invention.

Referring now more particularly to the drawings, there is shown in FIG. 1 an air bag assembly 10 comprising a housing 12 containing a plurality of gas generant pellets 14. Concentrically located within the chamber accommodating the gas. generant pellets 14 is a squib 16 having electrical lead wires 18. The squib 16 is surrounded by a foamed igniter material 20.

In operation, an electrical charge sent to the squib ignites the igniter 20, which sends hot gas through apertures 22 located in the housing 12. The hot gas serves to activate the gas generant pellets 14, which generate gas needed to inflate a folded air bag (not shown).

The gas generant pellets 14 may be from various known and novel materials suited for inflating an air bag. Representative gas generant 14 materials that may be used with the igniter of this invention include, by way of example, sodium azide gas generating compositions and sodium-azide-free compositions, including the following: compositions comprising oxidizable borohydride fuels as disclosed in U.S. Pat. No. 5,401,340; compositions comprising basic metal carbonates and/or basic metal nitrates as disclosed in U.S. Pat. No. 5,429,691 and U.S. Pat. No. 5,439,537; gas generant compositions containing non-metallic salts of 5-nitrobarbituirc acid, as disclosed in U.S. Pat. No. 5,472,534; anhydrous tetrazole gas generant compositions as disclosed in U.S. Pat. No. 5,472,647, U.S. Pat. No. 5,500,059, U.S. Pat. No. 5,501,823, and U.S. Pat. No. 5,516,377; and compositions comprising metal complexes as disclosed in U.S. Pat. No. 5,592,812 and U.S. Pat. No. 5,725,699. To the extent that the compositions of these United States patents are compatible for use with the inventive igniter, the complete disclosures of these patents are incorporated herein by reference. These gas generant materials are processible, and can be pressed into pellet or other usable form.

With the exceptions of the igniter material and igniter placement of this invention, the air bag assembly may be of a conventional design. Therefore, the conventional portions of the assembly need not and will not be described in any greater detail herein. The igniter material can also be used for a side impact and/or head impact supplemental restraint system. A general discussion of the structure and operation of such a supplemental restraint system is set forth in U.S. Pat. No. 5,441,303 and U.S. Pat. No. 5,480,181. To the extent that these referenced systems are compatible with the foam igniter of this invention, the complete disclosures of these United States patents are incorporated herein by reference. These referenced restraint systems are mentioned by way of example only to depict the general construction and operation of known systems. This invention is not limited to such systems.

The inventive igniter is readily adaptable for use with conventional hybrid air bag inflator technology. Hybrid inflator technology is based on heating a stored inert gas (argon or helium) to a desired temperature by burning a small amount of propellant. Hybrid inflators do not require cooling filters used with pyrotechnic inflators to cool combustion gases, because hybrid inflators are able to provide a lower temperature gas. The gas discharge temperature can be selectively changed by adjusting the ratio of inert gas weight to propellant weight. The higher the gas weight to propellant weight ratio, the cooler the gas discharge temperature.

A hybrid gas generating system comprises a pressure tank having a rupturable opening; a pre-determined amount of inert gas disposed within that pressure tank; a gas generating device for producing hot combustion gases and having means for rupturing the rupturable opening; and means for igniting the gas generating composition. The tank has a rupturable opening which can be broken by a piston when the gas generating device is ignited. The gas generating device is configured and positioned relative to the pressure tank so that hot combustion gases are mixed with and heat the inert gas. Suitable inert gases include, among others, argon and helium and mixtures thereof. The mixed and heated gases exit the pressure tank through the opening and ultimately exit the hybrid inflator and deploy the airbag.

Hybrid gas generating devices for supplemental safety restraint applications are described in Frantom, Hybrid Airbag Inflator Technology, Airbag Int'l Symposium on Sophisticated Car Occupant Safety Systems (Weinbrenner-Saal, Germany, Nov. 2–3, 1992).

The foamed material of this invention is formulated from a composition comprising, as ingredients, (a) a polymeric matrix formed from at least one polyfunctional isocyanate and at least one curable binder having a plurality of hydroxyl groups which are reactive with the polyfunctional isocyanate and (b) a foaming agent (or blowing agent) capable of imparting a relatively high porosity to the foamed material.

The polyfunctional isocyanate may be an aliphatic, cyclic aliphatic, or aromatic compound. Preferably, a cyclic aliphatic polyfunctional isocyanate, and more preferably an aromatic polyfunctional isocyanate is selected. Suitable aliphatic polyisocyanates include hexamethylene diisocyanate and biuret triisocyanate. An exemplary cyclic aliphatic polyfunctional isocyanate is isophorone diisocyanate. Exemplary aromatic polyfunctional isocyanates are a mixture of diphenyl methyl diisocyanate, methylene bisphenyl isocyanate, and polymethylene polyphenyl isocyanate (also known as "PAPI"); toluene diisocyanate ("TDI"); and methylenebis(phenyl isocyanate) ("MDI").

The foamed igniter material of this invention is characterized by a relatively high porosity. The porous nature of the foam igniter makes it more tolerant to high shock impacts. The high porosity of the inventive igniter material is achieved by introducing one or more foaming agents into the polymeric matrix before and/or during the curing process. As referred to herein, foaming agents may include gas originating from an internal source and/or an external source. More specifically, gases may be introduced externally, such as, for instance, by introducing one or more gases (preferably inert to the foamable igniter composition) into the pre-cured or curing polymeric matrix in a suitable vessel or device. Internally produced gases include those gases generated in situ by reaction between the polyisocyanate and a foaming agent, such as water. This reaction occurs simultaneously with and competes with the curing of the polymeric matrix. In principle, it is possible to select an appropriate chemical blowing agent that decomposes the generating the gases in situ to generate the gases for foaming the igniter composition. The external source may be, for example, nitrogen.

The foaming agent is introduced into the composition to decrease the density of the cured polymeric matrix. The density reduction can be selected for the specific restraint system. In principle, the resulting density can be from about 34% to about 76% of the maximum calculated theoretical density of the cured polymeric matrix. In other words, the volumetric growth of the porous polymeric matrix is from about 1.3 times (corresponding to 76%) to about 3 times (corresponding to 34%) relative to the maximum calculated theoretical density. Maximum theoretical density may be calculated by techniques well known to those of ordinary skill in the art by obtaining known densities of the ingredients and measuring ingredient concentrations. The actual measured density can also be determined by techniques well known to those of ordinary skill in the art. By way of example, actual measured density can be determined by foaming the material in a container of known weight and volume, and measuring the weight of the container and the foam portion within the container, i.e., removing the foam portion that expands beyond the container boundaries.

The burning and mechanical properties of the foamed igniter material of this invention may be adapted to correspond to the requirements of its intended application by selecting appropriate polymeric matrix ingredients, including additional ingredients, and controlling the amount and type of foaming agent.

In accordance with a first embodiment of the invention, the polymeric matrix is non-energetic. In this first embodiment, the curable binder having a plurality of hydroxyl groups which are reactive with the polyfunctional isocyanate may be one or more polyols. Exemplary polyols include, by way of example and without limitation, hydroxy-terminated polyenes including hydroxy-terminated polybutadiene ("HTPB"); polycaprolactone ("PCP"); poly (alkylene glycols), including poly(ethylene glycol) ("PEG"); poly(propylene glycol) ("PPG"); and poly(glycol adipate) ("PGA").

In accordance with second and third embodiments of the invention, the polymeric matrix is energetic. These embodiments are especially desirable in applications in which high energetic performance and large amounts of gas combustion are desired. Exemplary polyols include, by way of example and without limitation, glycidyl azide polymers ("GAP" or poly(glycidyl azide)) and poly(glycidyl nitrate) ("PGN"). High burn rate binders such as GAP provides enhanced performance, which may be highly desirable for some applications. The production of GAP and PGN is known to those skilled in the art, as shown in U.S. Pat. No. 5,264,596 and U.S. Pat. No. 5,801,325, the complete disclosures of which are incorporated herein by reference.

Fuel sources suitable for use with the first and second embodiments include, by way of example and without limitation, metals such as aluminum, boron, magnesium, silicon, titanium, zirconium, and alloys such as magnesium/aluminum alloys. The fuel is preferably in powder, particle and/or pellet form with a high surface area. Preferably, the fuel is homogeneously dispersed within the polymeric matrix.

The composition also usually includes one or more oxidizers. Suitable oxidizers include perchlorates, such as potassium perchlorate and ammonium perchlorate, and nitrates, such as potassium nitrate, sodium nitrate, and ammonium nitrate.

The composition further may include one or more surfactants, including silicone-based surfactants such as DOW 193.

The cure catalyst can be any of those known in the art, including dialkyltin carboxylates, including dibutyl tin dilaurate and dibutyl tin diacetate, and aryl bismuth compounds including triphenyl bismuth.

Where excess gas generation is desired, the foamed igniter material may be imbedded with gas generants, such as gas generant pellets, such as UIX-171 from Cordant Technologies Inc., previously known as Thiokol Corporation.

The ignition material is preferably made via a solvent-free process.

EXAMPLES

The foamed igniters in the following examples were prepared in substantially the same manner. PAPI curative was weighed in the specified amount and placed into a mixing vessel containing the pre-weighed polymeric binder. Next, the surfactant was added to the mixing vessel. A metal spatula was used to manually stir the materials contained in the vessel at ambient temperature until homogeneous. Then, water was added in the specified amount with an eyedropper and mixed with the spatula. Oxidizer, fuel, and/or gas generant pellets were then added in the amounts specified in the Tables below. Finally, dibutyl tin dilaurate as a cure catalyst was added to catalyze the exothermic reaction between the polyol and polyisocyanate and between the water and polyisocyanate. The resulting mixture was characterized by a high viscosity, but was still spreadable to permit it to be placed into an air bag assembly housing. The mixture is preferably applied early in the foaming process, which goes substantially to completion in ½ hour.

TABLE 1

(Example 1)

| Ingredient | Function | Weight % |
|---|---|---|
| HTPB | Binder | 24.54 |
| PAPI | Curative | 1.77 |
| DOW 193 | Surfactant | 1.58 |
| Water | Foaming agent | 1.86 |
| Ammonium Perchlorate | Oxidizer | 53.92 |
| Aluminum Powder | Fuel | 15.50 |
| Dibutyl Tin Dilaurate | Cure Catalyst | 0.83 |

TABLE 2

(Example 2)

| Ingredient | Function | Weight % |
|---|---|---|
| GAP | Binder | 28.19 |
| PAPI | Curative | 5.75 |
| DOW 193 | Surfactant | 1.61 |
| Water | Foaming agent | 1.72 |
| Ammonium Perchlorate | Oxidizer | 57.31 |
| Aluminum Powder | Fuel | 4.14 |
| Dibutyl Tin Dilaurate | Cure Catalyst | 1.28 |

TABLE 3

(Example 3)

| Ingredient | Function | Weight % |
|---|---|---|
| GAP | Binder | 28.19 |
| PAPI | Curative | 5.75 |
| DOW 193 | Surfactant | 1.61 |
| Water | Foaming agent | 1.72 |
| Ammonium Perchlorate | Oxidizer | 61.45 |
| Dibutyl Tin Dilaurate | Cure Catalyst | 1.28 |

TABLE 4

(Example 4)

| Ingredient | Function | Weight % |
|---|---|---|
| GAP | Binder | 29.49 |
| PAPI | Curative | 5.25 |
| DOW 193 | Surfactant | 1.59 |
| Water | Foaming agent | 1.82 |
| Ammonium Perchlorate | Oxidizer | 56.28 |
| Aluminum Powder | Fuel | 4.01 |
| Dibutyl Tin Dilaurate | Cure Catalyst | 1.56 |

TABLE 5

(Example 5)

| Ingredient | Function | Weight % |
|---|---|---|
| GAP | Binder | 38.97 |
| PAPI | Curative | 7.66 |
| DOW 193 | Surfactant | 1.52 |
| Water | Foaming agent | 2.25 |
| Pelletized UIX-171 | Gas Generant | 46.05 |
| Dibutyl Tin Dilaurate | Cure Catalyst | 2.89 |

TABLE 6

(Example 6)

| Ingredient | Function | Weight % |
|---|---|---|
| GAP | Binder | 75.6 |
| PAPI | Curative | 18.94 |
| DOW 193 | Surfactant | 1.89 |
| Water | Foaming agent | 1.89 |
| Dibutyl Tin Dilaurate | Cure Catalyst | 1.52 |

Figure 2:
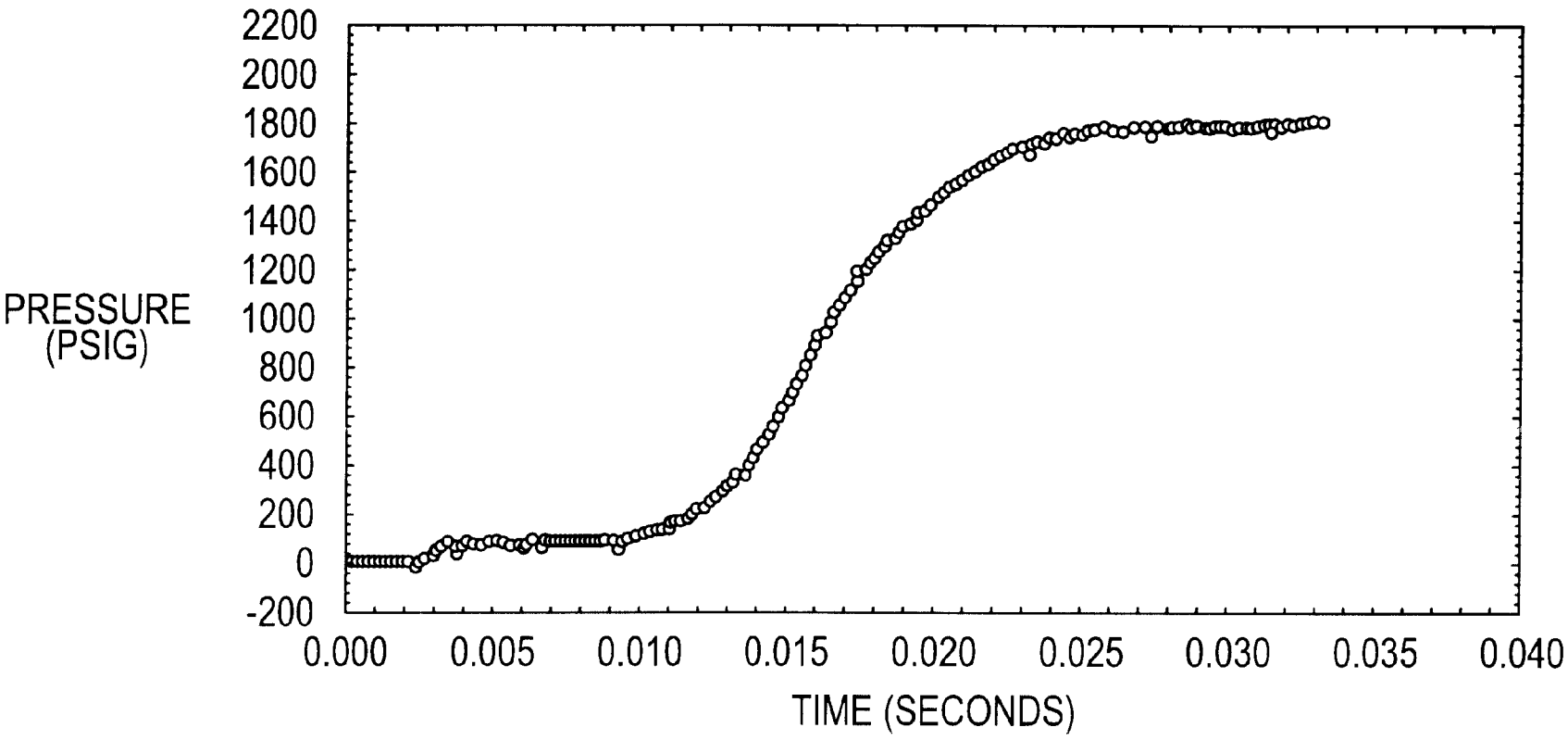
FIG. 2 is a low temperature (−45° C.) motor ignition pressure trace for an assembly including a foam igniter with a GAP binder.

A pressure-time trace for Example 3 is shown in FIG. 2. This trace shows the ideal burning characteristics of a small amount of foam igniter, e.g., 5.83 grams, which successfully ignited a test assembly having a 1 pound charge of a low smoke propellant. In particular, the low pressure plateau means that a uniform distribution of the high intensity wave front is being delivered to the propellant before buildup of pressure in the combustion chamber. A benefit of the pressure trace is the relatively low rate of pressure change inside the housing as the pressure increases. This characteristic is advantageous for applications in which the gas generant pellets to be ignited are known to have dp/dt characteristics where the combustion extinguishes after rapid changes in chamber pressure. The more gradual the pressure change at the beginning of the pressure increase, the less likely the gas generant pellets are to extinguish after the igniter material has been consumed.

The foregoing detailed description of the preferred embodiments of the invention has been provided for the purpose of explaining the principles of the invention and its practical application, thereby enabling others skilled in the art to understand the invention for various embodiments and with various modifications as are suited to the particular use contemplated. The foregoing detailed description is not intended to be exhaustive or to limit the invention to the precise embodiments disclosed. Modifications and equivalents will be apparent to practitioners skilled in this art and are encompassed within the spirit and scope of the appended claims.

What is claimed is:

1. An air bag assembly comprising:

an inflatable air bag;

a solid gas generant for inflating the inflatable air bag; and an igniter disposed in operative relation with the solid gas generant for activating the solid gas generant, the igniter comprising a foamed material formed from a composition comprising:

at least one polyfunctional isocyanate;

at least one curable binder having a plurality of functional groups which are reactive with the polyfunctional isocyanate;

at least one fuel source;

at least one oxidizer; and at least one foaming agent for imparting porosity to the foamed material.

2. An air bag assembly comprising:

an inflatable air bag;

a solid gas generant for inflating the inflatable air bag; and an igniter disposed in operative relation with the solid gas generant for activating the solid gas generant, the igniter comprising a foamed material formed from a composition comprising:

at least one polyfunctional isocyanate;

at least one non-energetic curable binder having a plurality of functional groups which are reactive with the polyfunctional isocyanate;

at least one fuel source;

at least one oxidizer; and at least one foaming agent for imparting porosity to the foamed material.

3. The air bag assembly of claim 2, wherein the binder comprises a polyol.

4. The air bag assembly of claim 2, wherein the polyol comprises hydroxy-terminated polybutadiene.

5. The air bag assembly of claim 2, wherein the polyfunctional isocyanate comprises a mixture of diphenyl methyl diisocyanate, methylene bisphenyl isocyanate, and polymethylene polyphenyl isocyanate.

6. The air bag assembly of claim 2, further comprising at least one surfactant and at least one cure catalyst.

7. The air bag assembly of claim 6, wherein the cure catalyst comprises dibutyl tin dilaurate.

8. An air bag assembly comprising:

an inflatable air bag;

a solid gas generant for inflating the inflatable air bag; and an igniter disposed in operative relation with the solid gas generant for activating the solid gas generant, the igniter comprising a foamed material formed from a composition comprising:

at least one polyfunctional isocyanate;

at least one energetic curable binder having a plurality of functional groups which are reactive with the polyfunctional isocyanate;

at least one fuel source other than the energetic binder;

at least one oxidizer; and at least one foaming agent for imparting porosity to the foamed material and is optionally retained in the foamed material.

9. The air bag assembly of claim 8, wherein the binder comprises a polyol.

10. The air bag assembly of claim 9, wherein the polyol comprises glycidyl azide polymer.

11. The air bag assembly of claim 9, wherein the polyol comprises poly(glycidyl nitrate).

12. The air bag assembly of claim 8, wherein the polyfunctional isocyanate comprises a mixture of diphenyl methyl diisocyanate, methylene bisphenyl isocyanate, and polymethylene polyphenyl isocyanate.

13. The air bag assembly of claim 8, further comprising at least one surfactant.

14. An air bag assembly comprising:

an inflatable air bag;

a solid gas generant for inflating the inflatable air bag; and an igniter disposed in operative relation with the solid gas generant for activating the solid gas generant, the igniter comprising a foamed material formed from a composition comprising:

at least one polyfunctional isocyanate;

at least one energetic curable binder having a plurality of hydroxyl groups which are reactive with the polyfunctional isocyanate;

at least one oxidizer; and at least one foaming agent for imparting porosity to the foamed material and is optionally retained in the foamed material, wherein the composition is free of any fuel.

15. The air bag assembly of claim 14, wherein the binder comprises glycidyl azide polymer.

16. The air bag assembly of claim 14, wherein the binder comprises poly(glycidyl nitrate).

17. The air bag assembly of claim 14, wherein the polyfunctional isocyanate comprises a mixture of diphenyl methyl diisocyanate, methylene bisphenyl isocyanate, and polymethylene polyphenyl isocyanate.

18. The air bag assembly of claim 14, further comprising at least one surfactant.

* * * * *